US010570772B2

(12) United States Patent
Smith et al.

(10) Patent No.: US 10,570,772 B2
(45) Date of Patent: Feb. 25, 2020

(54) COOLABLE WALL ELEMENT WITH IMPINGEMENT PLATE

(71) Applicant: Siemens Aktiengesellschaft, Munich (DE)

(72) Inventors: Rex Smith, Berlin (DE); Michael Williams, Port Saint Lucie, FL (US)

(73) Assignee: Siemens Aktiengesellschaft, Munich (DE)

( * ) Notice: Subject to any disclaimer, the term of this patent is extended or adjusted under 35 U.S.C. 154(b) by 16 days.

(21) Appl. No.: 15/742,169

(22) PCT Filed: Jul. 14, 2016

(86) PCT No.: PCT/EP2016/066772
§ 371 (c)(1),
(2) Date: Jan. 5, 2018

(87) PCT Pub. No.: WO2017/009420
PCT Pub. Date: Jan. 19, 2017

(65) Prior Publication Data

US 2018/0195409 A1 Jul. 12, 2018

(30) Foreign Application Priority Data

Jul. 15, 2015 (EP) ..... 15176873

(51) Int. Cl.
*F01D 25/12* (2006.01)
*F01D 25/24* (2006.01)
(Continued)

(52) U.S. Cl.
CPC ..... *F01D 25/12* (2013.01); *F01D 5/187* (2013.01); *F01D 9/041* (2013.01); *F01D 11/12* (2013.01);
(Continued)

(58) Field of Classification Search
CPC ..... F01D 25/12; F01D 25/246; F01D 9/04; F01D 5/08; F01D 5/085; F01D 5/088;
(Continued)

(56) References Cited

U.S. PATENT DOCUMENTS 3,606,406 A * 9/1971 Walters ..... F16B 21/02 403/240
4,337,016 A 6/1982 Chaplin
(Continued)

FOREIGN PATENT DOCUMENTS

EP 2789803 A1 10/2014
FR 2891862 A1 4/2007
(Continued)

OTHER PUBLICATIONS

IPEA (PCT/IPEA/416 and 409) dated Aug. 29, 2017, for PCT/EP2016/066772.
(Continued)

*Primary Examiner* — Steven M Sutherland
*Assistant Examiner* — Thuyhang N Nguyen
(74) *Attorney, Agent, or Firm* — Beusse Wolter Sanks & Maire

(57) ABSTRACT

A coolable wall element for a gas turbine, having a base body with a first surface subjectable to a hot gas, second surface arranged opposite of the first surface, and first seat for housing edges of an impingement plate. The wall element has an impingement plate partly inserted into the first seat located at a distance and adjacent to the second surface. A coolable wall element with extended life time is provided with the impingement plate which is removably attached to the base body having a snap-in connection with a bendable retention tab extending from the rest of the impingement plate to a free end of the retention tab, wherein the base body has a second seat for the free end of said tab, the second seat
(Continued)

blocks the moving of the impingement plate relative to the main body when the bendable retention tab is released.

11 Claims, 2 Drawing Sheets

(51) Int. Cl.
*F01D 11/12* (2006.01)
*F01D 5/18* (2006.01)
*F01D 9/04* (2006.01)
*F23R 3/16* (2006.01)

(52) U.S. Cl.
CPC ..... *F01D 25/246* (2013.01); *F23R 3/16* (2013.01); *F05D 2220/32* (2013.01); *F05D 2230/64* (2013.01); *F05D 2230/70* (2013.01); *F05D 2240/11* (2013.01); *F05D 2260/201* (2013.01); *F05D 2260/38* (2013.01); *F05D 2300/501* (2013.01); *F23R 2900/03044* (2013.01); *Y10T 29/4987* (2015.01); *Y10T 29/49318* (2015.01); *Y10T 29/49323* (2015.01); *Y10T 29/49863* (2015.01); *Y10T 29/49867* (2015.01); *Y10T 29/49869* (2015.01)

(58) Field of Classification Search
CPC ..... F01D 11/08; F01D 11/24; F01D 25/24; F23R 3/002; F23R 2900/00017; F23R 2900/00018; F23R 2900/03044; F05D 2230/64; F05D 2260/201; F05D 2240/11; Y10T 403/58; Y10T 403/581; Y10T 403/583; Y10T 29/49863; Y10T 29/49867; Y10T 29/49869; Y10T 29/4987; Y10T 29/49872; Y10T 29/4986; Y10T 29/49323; Y10T 29/49318; B23P 15/008; B23P 2700/13
See application file for complete search history.

(56) References Cited

U.S. PATENT DOCUMENTS

| | | | | |
|---|---|---|---|---|
| 4,712,979 | A | 12/1987 | Finger | |
| 5,391,052 | A | 2/1995 | Correia et al. | |
| 7,997,856 | B2 * | 8/2011 | Khanin | F01D 11/08 415/116 |
| 8,439,629 | B2 * | 5/2013 | Pietraszkiewicz | F01D 11/08 415/116 |
| 9,404,580 | B2 * | 8/2016 | Clouse | F16J 15/0887 |
| 2007/0104571 | A1 | 5/2007 | Drerup et al. | |
| 2011/0044805 | A1 | 2/2011 | Koyabu et al. | |
| 2012/0027572 | A1 | 2/2012 | Denece et al. | |

FOREIGN PATENT DOCUMENTS

| | | | |
|---|---|---|---|
| JP | 2012519803 | A | 8/2012 |
| WO | 2014186166 | A1 | 11/2014 |

OTHER PUBLICATIONS

International Search Report dated Sep. 26, 2016, for PCT/EP2016/066772.
EP Search Report dated Jan. 8, 2016, for EP patent application No. 15176873.6.

* cited by examiner

COOLABLE WALL ELEMENT WITH IMPINGEMENT PLATE

CROSS REFERENCE TO RELATED APPLICATIONS

This application is the U.S. National Stage of International Application No. PCT/EP2016/066772 filed Jul. 14, 2016, and claims the benefit thereof. The International Application claims the benefit of European Application No. EP15176873 filed Jul. 15, 2015. All of the applications are incorporated by reference herein in their entirety.

FIELD OF INVENTION

The invention relates to an impingement coolable wall element for a gas turbine, comprising a base body having a first surface subjectable to a hot gas, a second surface which is arranged opposite of the first surface and a first seat for a housing edges of an impingement plate, the wall element further comprising an impingement plate partly inserted into the first seat, located at a distance and adjacent to the second surface. The invention relates also to a method for assembling/disassembling an impingement plate onto/from the base body of a coolable wall, providing a base body having a first surface subjectable to a hot gas, a second surface which is arranged opposite of the first surface and a first seat for housing edges of an impingement plate.

BACKGROUND OF INVENTION

The before mentioned coolable wall elements are well known as ring segments in the prior art. These ring segments, also known as blade outer air seals, are usually arranged within the gas turbine for bordering the hot gas path of a turbine section. These ring segments are arranged along the circumferential direction whereby all segments of a circumference create a ring. Inside of said ring, turbine blades mounted on the rotor of the turbine moves along their hot gas path surface when said turbine rotor is rotating during operation.

Usually said ring segments are carried by a turbine vane carrier. Usual turbine vane carriers are in cross section perpendicular to the machine axis in annular shape and for stationary gas turbines split into a lower half and an upper half. The turbine vane carrier has grooves extending in the circumferential direction in which the ring segments could be slid to their dedicated position one by one to form outer border of the hot gas path.

Due to the hot gas flowing along the ring segments, said ring segments have to be cooled to reach their predetermined life time. For cooling purposes it is known to attach an impingement plate on the outer side of the ring segments in such a way, that the ring segment could be cooled by air impinging on the cold side of the ring segment thereby carrying away the thermal energy of the wall of the ring segment.

To provide a reliable ring segment the impingement plate must be held in the fixed position without significant motion. For this, in the past impingement plates were welded or brazed directly to the main body of the ring segment.

Further, WO 2014/186166 A1 discloses a cooling arrangement having a snap-in impingement plate. In detail each of the four edges of the impingement plate sits in a corresponding groove without being welded or brazed. However, the impingement plate needs folded edges to clamp the respective edges into corresponding grooves. The provision of these folded edges seems expensive.

Besides this, EP 2 789 803 A1 discloses a u-shaped impingement ring element, which is assembled into a circumferential groove of a ring shaped carrier through which cooling air is guided to the impingement ring element. The ring element comprises a retainer tab as a stopping element prohibiting a radial movement between the impingement ring element and its groove, the groove being opened in radial direction.

SUMMARY OF INVENTION

Therefore the problem of this invention according to ring segments is to provide an impingement coolable wall element comprising a base body which is subjected to a hot gas and on the opposite side of an impingement plate, all with an extended life time. A further object of the invention is to provide a method for assembling/disassembling an impingement plate onto/from the base body of a coolable wall which could be performed easily and fast without any additional tools.

The problem according to the coolable wall element is solved by a coolable wall element according comprising the features of the claims. The problem according to the assembling method is solved by the method according to the features of the claims and the problem for disassembling an impingement plate from the base body of a coolable wall is solved by the features of the claims.

By avoiding welding and brazing operations during manufacturing of the ring segment, the thermal stress encountered during weld operation (or braze operation) within the base body and within the impingement plate is eliminated. Internal tensions resulting from this thermal stress are avoided. Also by avoiding said stress and tensions, the dimensions of the coolable wall are kept as they are machined. This results in an extended life time and in a wall element with improved accuracy. The easy design of coolable wall having an impingement plate removable attached to the base body comprises snap lock comprising a bendable retention tab extending from the rest of the impingement plate to a free end of said retention tab, wherein the base body comprises a second seat for the free end of said tab, said second seat is configured to block the moving of the impingement plate relative to the base body when the bendable retention tab is released.

A further advantage of the invention is that the impingement plate is easy to remove during repair and refurbishment of the coolable wall element. The plate can be easily removed and reinstalled from/onto the base body in the field for inspecting and cleaning the coolable wall element. Further, assembly costs could be reduced, manufacturing time could be saved and also cost for repairing cooled wall element could be reduced.

Both methods have the same idea, that for inserting or removing the impingement plate into or from its final assembling position onto the base body the retention tab as monolithic part of the impingement plate has to be elastically bent for passing the blocking element which is arranged onto the base body.

In detail the method for assembling an impingement plate onto the base body of the coolable wall, comprises the steps of—providing a base body having a first surface subjectable to a hot gas, a second surface which is arranged opposite of the first surface and a first seat for housing edges of an impingement plate and wherein the base body comprises at each edge of two opposing edges of the second surface a step each comprising a groove as the first seat of the impingement plate, the grooves have opposing first openings facing to each other, said grooves each having a second opening through which opposing edges of the impingement plate are insertable into the corresponding grooves, wherein the base body comprises a second seat dedicated to receive a free end of a tab of an impingement plate, said second seat is configured to block the moving of said impingement plate relative to the base body when the bendable retention tab is released,—providing an impingement plate comprising a bendable retention tab extending from the rest of the impingement plate to a free end of said retention tab, and—inserting the impingement plate into said grooves and sliding along the grooves while temporarily lifting the retention tab in a direction away from the second surface until the impingement plate approaches its final assembly position and—releasing or bending the retention tab, such that its free end sits in the second seat where it is blocked prohibiting any further movement of the impingement plate relative to the base body.

The method for disassembling an impingement plate from the base body of a coolable wall comprises the steps of first lifting elastically or plastically the retention tab and second moving the impingement plate out of its final assembly position while keeping the retention tab bent at least temporarily. This is easy to perform.

Further embodiments are mentioned in the depending claims, whereby their features could be easily combined in any way.

According to a first embodiment the impingement plate comprises a bendable retention tab extending from the rest of the impingement plate to a free end of said retention tab, wherein the base body comprises a second seat for the free end of said tab, said second seat is configured to block the moving of the impingement plate when the bendable retention tab is released.

According to this embodiment the bending of a specific element, here the retention tab has only to be used during assembly. In the final position all elements of the coolable wall element are released and remain unbend without any internally tension or mechanical stress. This provides an enhanced life time of the wall element while using a snap lock for keeping the impingement plate in position.

A further embodiment proposes a second seat comprising a pin located adjacent to the free end of the retention tab blocking the movement of said retention tab. This small feature provides an easy construction for removable attaching the impingement plate onto the base body.

In an additional embodiment the base body comprises at each edge of two opposing edges of the second surfaces a step having a groove as the first seat for opposing edges of the impingement plate, said grooves each having a second opening through which said edges of the impingement plate are insertable into their corresponding grooves. This provides an easy and reliable construction for holding the impingement plates onto the base body.

Further, the free end of the retention tab is curved. In other words: the retention tab comprises a handle. Said curved end of the retention tab is an easy to manufacture handle for service persons that have to assemble or disassemble the impingement plate onto or from the base body.

For providing a reliable and a long life impingement plate in a further embodiment the retention tab is partly separated from the rest of the impingement plate by a slot, said slot comprising an outer end located at one of the edges of the impingement plate and an inner end opposing the outer end, wherein said inner end has a keyhole shape.

This shape avoids notch stresses surrounding the inner end of said slot.

In an embodiment the coolable wall element could be part of a turbine blade, part of a turbine vane, part of a combustor wall or a ring segment. Especially the proposed impingement cooled wall can be part of a platform of a turbine vane or turbine blade.

The above mentioned properties, features and advantages of the invention as well as the way how to achieve these with ease, are explained further in the combination with the following description of the illustrated and exemplary embodiments of the invention according to the attached figures.

DETAILED DESCRIPTION OF INVENTION

In all figures identical features will have assigned with same reference numbers.

The explanation of the invention is made with the aid of a ring segment of a gas turbine. Nevertheless the coolable wall element 10 according to the invention could be applied also on other devices of a gas turbine. Other devices could be also the platform of a turbine vane which is also cooled by impingement cooling, a turbine blade attachable to a rotor of a gas turbine or an impingement cooled wall element of a combustor shell.

Figure 3:
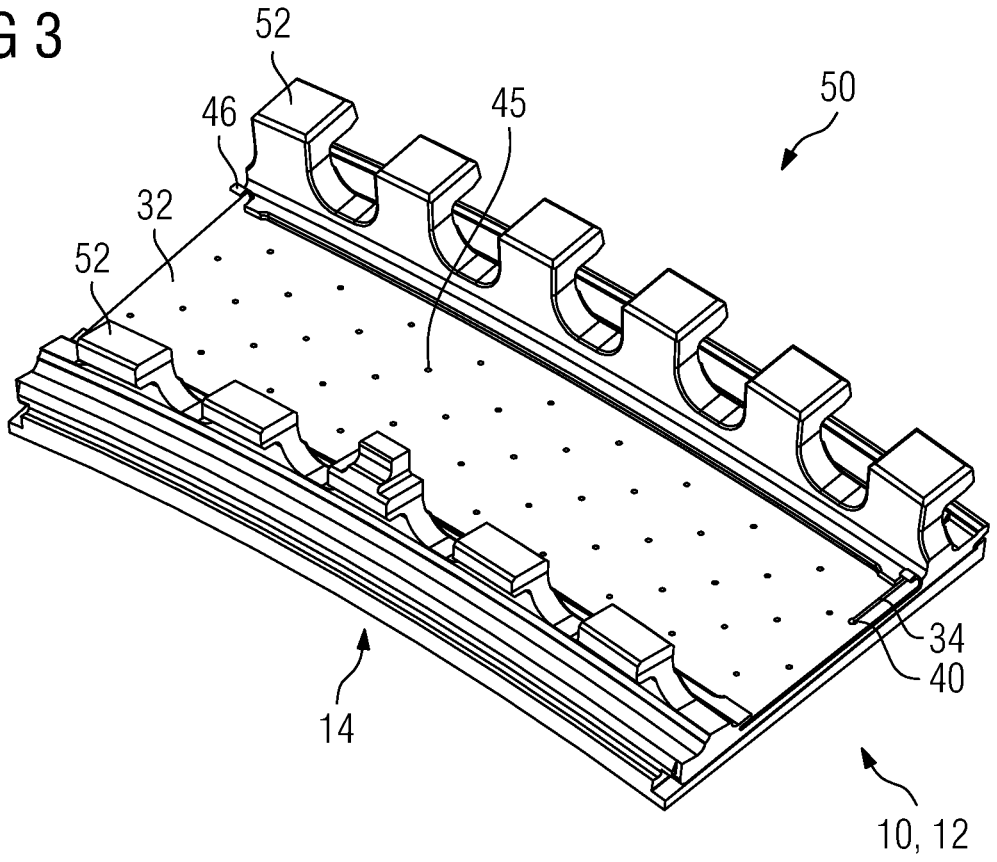
FIG. 3 shows a coolable wall element with an attached impingement plate.
Figure 4:
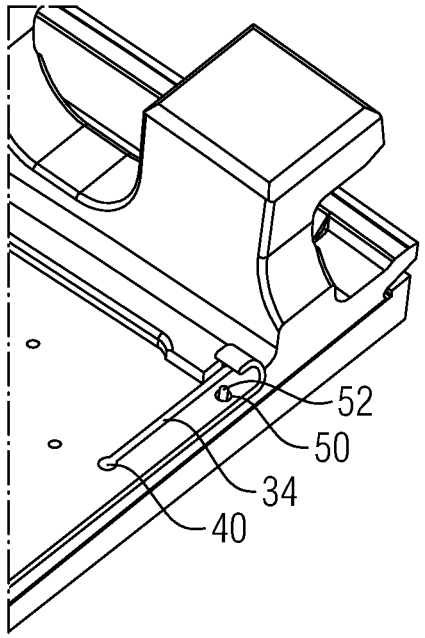
FIG. 4 shows a detail view of the wall element with the attached impingement plate of FIG. 3.

FIG. 3 displays in a perspective view a ring segment 50 as a coolable wall element 10 comprising a base body 12 and a removable attached impingement plate 32. Hooks 52 located in the cold side of the base body 12 are used to attach the ring segment to a turbine vane carrier (not shown).

Figure 1:
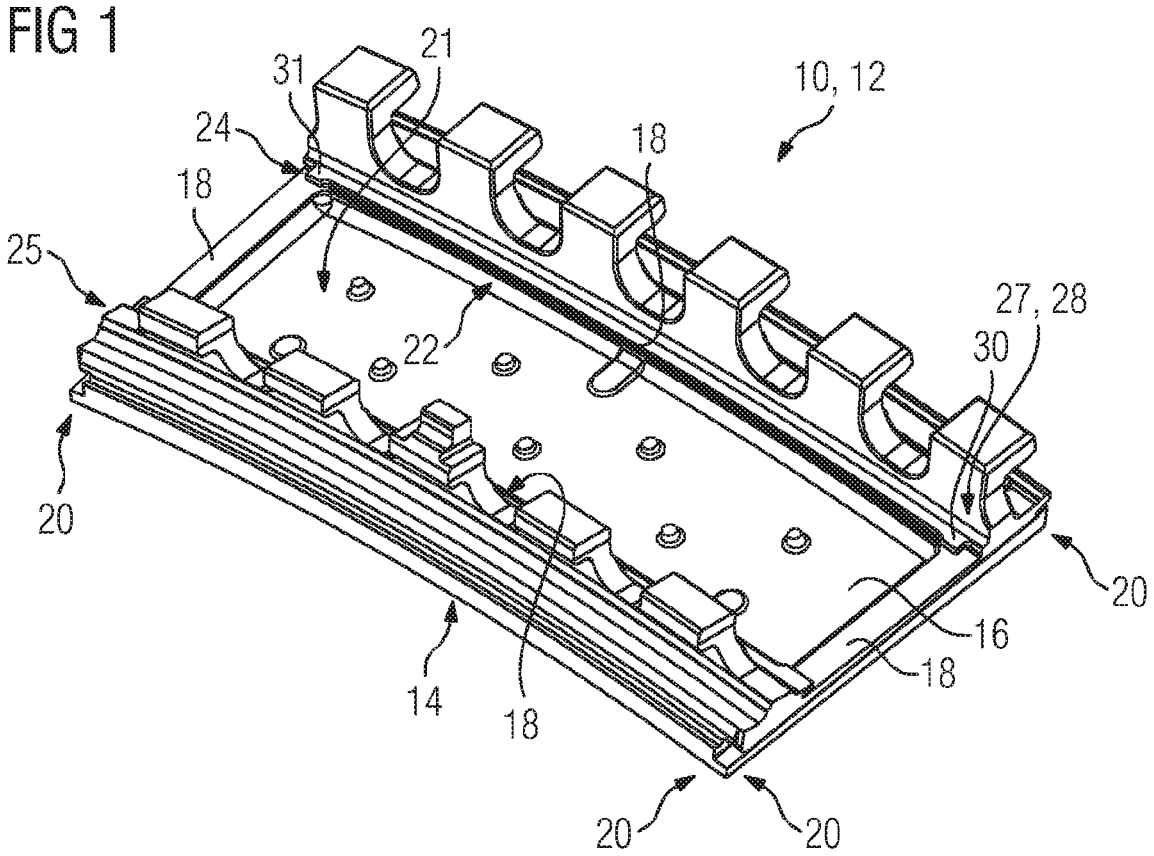
FIG. 1 shows in a perspective view a base body of a coolable wall element according to a first exemplary embodiment.

FIG. 1 displays only the base body 12, which comprises a first surface 14, which is subjectable to a hot gas, when the coolable wall element is assembled in a gas turbine. Opposite of the first surface 14 the base body 12 has a second surface 16 which is dedicated to be cooled by impingement cooling air jets generated by an impingement plate (not shown). The base body 12 comprises further on the second surface 16 steps 18 which are located at opposing edges 20 of the base body 12. Said steps 18 each extend along said edges 20. Advantageously, each of the four edges 20 of the base body 12, which usually has a rectangular shape, comprises a step 18 while surrounding the second surface 16 of the base body in a closed way. All steps 18 merge at their respective ends thus forming a tub 21 as a space to be covered by the impingement plate for impingement cooling.

In this example two of these steps 18, have a height measured from the level of the second surface 16 which is larger than the height of the other edges 20. In two opposing steps 18 having the larger height grooves 22 are arranged therein providing a first seat for an impingement plate. These grooves 22 have opposing first openings facing to each other. Beside these first openings each groove 22 has on a face 25 of the base body 12 a second opening 24 through which opposing edges of the impingement plate could be slid in.

In one corner 27 of the base body 12 on the side of the second surface 16 a second seat 28 is located for receiving a specific part of the impingement plate, which will be explained later. The seat 28 is partly bordered by a pin 30. The second seat 28 could also be located on other positions along the groove 22.

Figure 2:
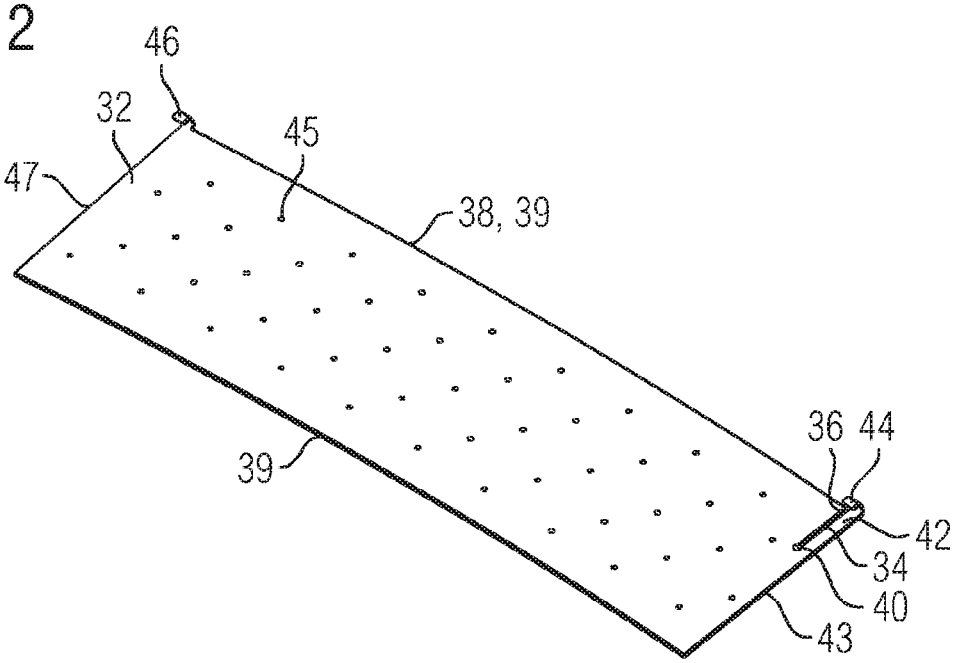
FIG. 2 shows a perspective view of an impingement plate according to the invention.

FIG. 2 shows a perspective view onto an impingement 32 sheet according to the invention. The impingement sheet 32 has a corresponding shape with regard to the coolable wall element and according to this exemplary embodiment the shape of the impingement plate 32 is mainly rectangular and mainly flat. For creating retention tap 42 monolithically attached to the rest of the impingement plate 32 a slot 34 is machined therein. Said slot 34 has an outer end 36 located at one of the edges 38 of the impingement plate 32 and an inner end 40 opposing outer end 36 wherein said inner end has a keyhole shape for reducing notch stresses. The slot 34 has a very small gap width and extends parallel to a second edge 43 of the impingement plate 32 while creating a retention tab 42. This results in said retention tab 42 having a free end 44. The free end 44 has a curved design for creating a handle. The rest of the impingement plate 32 and may be also the retention tab 42 comprises a set of impingement holes 45 arranged in a regular or irregular pattern. Cooling air could flow through the impingement holes 45 while creating impingement jets for cooling the base body, when the coolable wall element or the ring segment is assembled in a respective gas turbine which is operated.

The impingement plate 32 comprises further a cam 46 extending an edge 47, said edge 47 is opposite located of second edge 43.

To create said coolable wall element 10 respectively a ring segment 50 the above mentioned impingement plate 32 and its corresponding, opposing edges 39 has to be inserted into the second openings 24 of grooves 22 of the base body 12. The second edge 43 of the impingement plate 32 comprising the retention tab 42 is inserted first into the second openings 24 of the grooves 22 while lifting elastically the retention tab 42 that much, that the retention tab 42 does not block any movement. In detail, the retention tab 42 is bent that much, that its free end 44 is arranged outside the groove 22. The impingement plate 32 with its lifted retention tab 42 is moved into its final position, where the impingement plate 32 fully covers the tub 21. When the cam 46 reaches a pin 31 located at the base body 12, the impingement plate 32 has reached its final assembly position. Latest then the retention tab 42 is to release. When releasing the retention tab 42 the free end 44 moves into the second seat 28. In other words: the retention tab 42 snaps back into its unbend position. In this position, the pin 30 blocks the motion of the retention tab 42 in the direction of the grooves 22, as the combination of pin 30 and pin 31 does also. In this position the impingement plate 32 is firmly fixed but also removable attached onto the base body while creating a coolable wall element 10. For disassembling, the actions have to be performed vice versa.

Other blocking constructions for the snap lock are also possible. In example instead or in addition of pin 30 the second seat 28 could comprise a pedestal 60, which could extend into a hole 62 which could be located on the free end of the retention tab.

FIG. 3 displays in a perspective view a ring segment 50 comprising the base body 12 and said removable attached impingement plate 32. Hooks 52 located in the cold side of the base body 12 are used to attach the ring segment to a turbine vane carrier (not shown).

The invention claimed is:

1. A coolable wall element for a gas turbine, comprising:

a base body comprising a first surface subjectable to a hot gas, a second surface which is arranged opposite of the first surface and a first seat for housing opposing edges of an impingement plate, the impingement plate partly inserted into the first seat, the impingement plate located at a distance and adjacent to the second surface being removably attached onto the base body, wherein the base body comprises at each edge of two opposing edges of the second surface a step each comprising a groove, wherein the grooves comprise opposing first openings facing to each other, said grooves each comprising a second opening through which said opposing edges of the impingement plate are insertable into the corresponding grooves, wherein the impingement plate is assembled into the grooves by aligning each of the two opposing edges of the impingement plate end-to-end with the respective second opening of each groove and translating the impingement plate parallel to the grooves so that the two opposing edges progressively enter the grooves until the impingement plate reaches a final assembly position, wherein the impingement plate comprises a bendable retention tab extending from the impingement plate to a free end of said bendable retention tab, wherein the bendable retention tab is flexed from an unbiased position as the impingement plate is translated, and wherein the base body comprises a second seat for the free end of said bendable retention tab, said second seat is configured to block movement of the impingement plate, relative to the base body when the bendable retention tab is released, wherein the bendable retention tab is released when the impingement plate reaches the final assembly position.

2. The wall element according to claim 1, wherein the second seat located on the second surface comprises a pin located adjacent to the free end of the bendable retention tab prohibiting movement of said bendable retention tab relative to the base body.

3. The wall element according to claim 1, wherein the second seat comprises a pedestal and said bendable retention tab comprises at the free end thereof a hole, wherein, when the bendable retention tab is released, the pedestal extends into said hole to block of the impingement plate relative to the base body.

4. The wall element according to claim 1, wherein the free end comprises a handle.

5. The wall element according to claim 1, wherein the bendable retention tab is partly separated from a rest of the impingement plate by a slot, said slot comprising an outer end located at one of the edges of the impingement plate and an inner end opposing the outer end, wherein said inner end comprises a key hole shape.

6. A turbine blade, turbine vane, ring segment or combustor shell element comprising:

a wall subjectable to the hot gas, wherein said wall is configured according to the wall element according to claim 1.

7. A method for disassembling the impingement plate from the base body of the coolable wall element according to claim 1, the method comprising:

first lifting elastically or plastically the bendable retention tab, and second moving the impingement plate out of the final assembly position while keeping the bendable retention tab bent at least temporarily.

8. A method for assembling an impingement plate onto a base body of a coolable wall, comprising the base body comprising a first surface subjectable to a hot gas, a second surface which is arranged opposite of the first surface and a first scat for housing opposing edges of the impingement plate and wherein the base body comprises at each edge of two opposing edges of the second surface a step each comprising a groove as the first scat of the impingement plate, the grooves comprise opposing first openings facing to each other, said grooves each comprising a second opening through which said opposing edges of the impingement plate are insertable into the corresponding grooves, wherein the base body comprises a second seat dedicated to receive a free end of a bendable retention tab of the impingement plate, said second seat is configured to block movement of said impingement plate relative to the base body when the bendable retention tab is released, and the impingement plate comprising the bendable retention tab extending from a rest of the impingement plate to the free end of said bendable retention tab, the method comprising:

aligning each of the two opposing edges of impingement plate end-to-end with the respective groove and then translating the impingement plate in a direction parallel to the grooves so that the two opposing edges enter the grooves while temporarily lifting the bendable retention tab in a direction away from the second surface and into a biased position until the impingement plate approaches a final assembly position, and releasing or bending the bendable retention tab from the biased position, such that the free end of the bendable retention tab that has been released from the biased position sits in the second seat where the free end prohibits any further movement of the impingement plate relative to the base body.

9. A coolable wall element for a gas turbine, comprising:

a base body comprising a first surface, a second surface opposite the first surface, a first side, a second side opposite the first side, a third side that connects the first side and the second side, and a fourth side opposite the third side, a retention feature, a first groove that extends along the first side and the first surface, and a second groove that extends along the second side and along the second surface and parallel to the first groove, wherein open faces of the grooves face each other;

an impingement plate comprising a first edge, a second edge opposite the first edge, and a retention tab configured to flex from an unbiased position to a biased position;

wherein installation of the impingement plate is effected by aligning the first edge end-to-end with the first groove, simultaneously aligning the second edge end-to-end with the second groove, flexing and holding the retention tab in the biased position, and then translating the impingement plate parallel to the grooves so that the first edge progressively enters the first groove and the second edge progressively enters the second groove until the impingement plate reaches a final assembly position, and wherein in the final assembly position the retention tab is released from the biased position to the unbiased position in which the retention tab engages the retention feature to prevent movement of the impingement plate relative to the base body.

10. The coolable wall element for a gas turbine of claim 9, wherein during the installation the retention tab is held away from the unbiased position by the base body until reaching the retention feature.

11. The coolable wall element for a gas turbine of claim 9, wherein the retention feature comprises a pin configured to block movement of the retention tab associated with translation of the impingement plate along the grooves when the retention tab is in the unbiased position.

* * * * *